United States Patent [19]

Maldonado et al.

[11] Patent Number: 4,984,261

[45] Date of Patent: Jan. 8, 1991

[54] X-RAY TUBE HEAD ASSEMBLY

[75] Inventors: Robert Maldonado, Santa Clara, Calif.; Jack H. Faude, King of Prussia, Pa.

[73] Assignee: MDT Corporation, Torrance, Calif.

[21] Appl. No.: 440,587

[22] Filed: Nov. 21, 1989

[51] Int. Cl.[5] ..... H05G 1/04; H05G 1/02; H01J 35/10

[52] U.S. Cl. ..... 378/202; 378/199; 378/193; 378/200; 378/130; 378/127; 378/141

[58] Field of Search ..... 378/193, 194, 195, 196, 378/197, 199, 198, 200, 201, 202, 203, 130, 127, 128, 141, 129, 142

[56] References Cited

U.S. PATENT DOCUMENTS 4,350,891 9/1982 Wuerflein .

FOREIGN PATENT DOCUMENTS 2802319 8/1978 Fed. Rep. of Germany ..... 378/200
1066256 4/1967 United Kingdom ..... 378/141

*Primary Examiner*—Janice A. Howell
*Assistant Examiner*—Don Wong
*Attorney, Agent, or Firm*—Trask, Britt & Rossa

[57] ABSTRACT

Cooling oil for an X-ray tube head assembly is contained within a resilient elastomeric envelope together with a high voltage assembly.

17 Claims, 3 Drawing Sheets

X-RAY TUBE HEAD ASSEMBLY

BACKGROUND OF THE INVENTION

1. Field

This invention relates to X-ray machines, specifically the tube head assemblies of such machines. It is specifically directed to a resilient container for the cooling oil and high-voltage subassembly of a lightweight tube head assembly.

2. State of the Art

The tube head assemblies of X-ray machines used within the dental profession typically include an X-ray tube, means to generate the voltages required to power the X-ray tube, lead shielding to prevent radiation from leaking from the assembly, and a housing which serves both as a rigid mounting structure for the other components and as a container for cooling medium, typically transformer cooling oil A transformer is used to step up and step down, as required, a source voltage to those required by the X-ray tube. In dental X-ray machines, a voltage of approximately 65,000 volts may be applied across the tube electrodes while a voltage on the order of 3 volts may be applied to the tube filament. It has become conventional practice to contain the cooling medium within an enclosure having pressure responsive capability. The capability is provided by a bellows, sleeve, or diaphragm of elastomeric resilient material associated with the enclosure. This oil container allows for the expansion and contraction of the transformer oil with fluctuating temperatures; it is positioned within the housing and contains the high-voltage subassembly, including the transformer.

For X-ray machines generally, it is important for the tube head assembly to be of compact and lightweight design. It is also desirable that the tube head assembly be constructed within a reliable oil-tight enclosure which will remain oil-tight over the entire life of the tube head assembly. It is also important that the dielectric strength between the various high-voltage components and between the components and ground potential be effective to avoid arcing.

Relatively recent developments in regulated X-ray tube power supplies which operate at high frequency have been advantageously adapted to dental X-ray machines and similar machines within the same class (e.g., portable X-ray units). Modern power supplies which are capable of producing low ripple high voltage power provide a relatively high X-ray energy output per unit of time, thereby reducing the exposure time required to produce diagnostically significant radiographs. U.S. Pat. No. 4,350,891 discloses an exemplary such power supply and associated logic and control circuitry. The disclosure of U.S. Pat. No. 4,350,891 is incorporated herein by reference for its disclosure of a lightweight high frequency power supply for dental systems capable of producing both voltage and current controlled power at low ripple for efficient X-ray tube operation. The power supply illustrated by FIGS. 1, 2 and 4 of that patent is illustrative of the kind of power supply useful for the class of X-ray tube head assemblies with which this invention is concerned. The block diagram of FIG. 3 of U.S. Pat. No. 4,350,891 is also incorporated by reference for its illustration of an X-ray system embodied by X-ray machines of the class to which this invention belongs.

Housings for dental X-ray tube head assemblies have typically been fabricated from either aluminum castings or sheet metal. The requirement for highly effective seals to prevent oil leaks has been recognized. The effective sealing of cooling oil within the tube head of necessity must allow for the expansion and contraction of the contained oil as the oil is heated or cools as a consequence of operation of the X-ray machine. Accordingly, it is essential in X-rays machines of this type that the tube head incorporate means for preventing excess pressure from building up within the interior of the tube head assembly. Several expedients are in use currently, but none is entirely satisfactory.

According to some designs, a bellows filled with air is mounted inside the tube head housing and is vented through the housing to the atmosphere. As the oil contained by the housing expands, it displaces air from the bellows. As the oil cools and contracts, the bellows returns to its normal volume, thereby drawing in ambient air. Certain other tube heads are constructed in a fashion which permits a resilient oil container to expand under the influence of expanding oil and to contract to a characteristic volume when the oil cools. The resilient portion of the container consists of a rubber sleeve mounted between metal ends, being secured to each end by a hose clamp. Other tube head assemblies provide a resilient diaphragm sealing a hole in the housing, thereby permitting an increase in internal volume within the housing as the diaphragm is urged into the hole.

All tube head assemblies require X-ray shielding. Lead is typically positioned either inside or outside the housing, but is preferably placed outside to avoid contact with oil. In the event that flakes of lead find their way into the oil, they can migrate into contact with the internal components of the high-voltage subassembly, creating a high-voltage discharge inside the tube head.

There remains a need for a tube head assembly of improved reliability with respect to the provision of fluctuating volume to accommodate the expansion and contraction of cooling oil. There also remains a need for improved dielectric strength properties between components of the high-voltage subassembly and outside ground potential. It would also be highly desirable to provide a tube head assembly with a decreased volume of cooling oil, thereby reducing the weight of the tube head assembly.

SUMMARY OF THE INVENTION

This disclosure emphasizes the invention embodied in a dental X-ray machine. It should be understood, however, that the invention can be embodied in the tube head assemblies of X-ray machines intended for use in other applications, notably podiatric medicine and portable X-ray units. The tube head assembly of this invention is generally of the class in which a high-voltage subassembly, including a transformer and associated circuitry, particularly power supply circuitry, is immersed in oil within a housing and in which the housing is sealed against oil leakage while providing for the expansion and contraction of oil within the housing.

The tube head assembly of this invention comprises a mounting element including a rigid mounting surface which constitutes means for carrying the components of a high-voltage subassembly. The mounting surface is typically provided on a structural element such as an aluminum bulkhead adapted opposite the mounting surface to connect to other components in a trunnion assembly. The mounting surface is circumscribed by peripheral structure configured to couple with the open end of an enclosing element. The enclosing element and mounting element together define a container for cooling oil.

The enclosing element is of elastomeric material, typically a synthetic rubber or its equivalent, positioned to enclose the high-voltage subassembly within a continuous envelope, the envelope having an opening coupled in a fluid-sealed relationship with the peripheral surface of the mounting element. Coupling of the enclosing element to the mounting element may be accomplished in various ways but is conveniently effected with a hose clamp configured in harmony with the peripheral structure.

The oil envelope is contained within an X-ray-shielding housing attached to the mounting element. The internal volume of the housing is sufficient to accommodate the expanded volume of the enclosing element when oil is in an expanded condition due to heating.

The oil envelope may be viewed as a bag which serves a dual purpose; namely, as an oil-tight housing in conjunction with the mounting element and as means for compensating for the expansion and contraction of the oil with fluctuating temperatures. Because the envelope serves this important compensation function within the shielding housing, there is no need for a separate bellows, sleeve, or diaphragm to accommodate expanding oil. Accordingly, the invention provides a means for improving the reliability of the oil seal as compared to the use of sleeves and also avoids those structures such as bellows and diaphragm which require communication through the housing to accommodate air exhaust or mechanical movement of the diaphragm.

The enclosing element or oil envelope of this invention has a normal or characteristic unexpanded shape and volume. It should be sufficiently resilient that even after repetitive and prolonged use it tends to return to its characteristic shape and volume at any time that the oil it contains decreases in volume from its expanded condition. Thus, the envelope swells and contracts repeatedly within the X-ray shielding housing without affecting the seal or developing voids in the oil communicating with the oil bathed components.

A preferred structure of this invention interposes a sleeve, preferably a semi-rigid insulating sleeve, between the high-voltage subassembly and the enclosing element. This structural sleeve serves as means for limiting the approach of the wall of the enclosing element towards the components of the high-voltage voltage subassembly. Moreover, when constructed of insulating material, it provides a higher dielectric strength between the high-voltage components and outside ground potential. Because the high-voltage assembly together with the X-ray tube and filament transformers used in the construction of the tube head assembly of this invention are relatively small, the internal volume of the oil envelope may be less than is typical of available tube head assemblies. Accordingly, less cooling oil is required, and consequently the weight of the completed tube head assembly is reduced.

The X-ray-shielding housing contemplated by this invention is constructed of lead carried by a rigid, typically plastic, liner. By this means, lead shielding is kept to the exterior of the housing and is isolated from the internal- components of the tube head assembly and the cooling medium.

The tube head assembly and the individual structural elements of the assembly may take a variety of shapes and forms. As currently envisioned, the most convenient and least expensive embodiments from a structural and fabrication standpoint are approximately cylindrical, with individual components assembled concentrically and coaxially, being supported as required from the mounting element.

BRIEF DESCRIPTION OF THE DRAWINGS

In the drawings, which illustrate what is presently regarded as the best mode for carrying out the invention.

DESCRIPTION OF THE ILLUSTRATED EMBODIMENT

Figure 1:
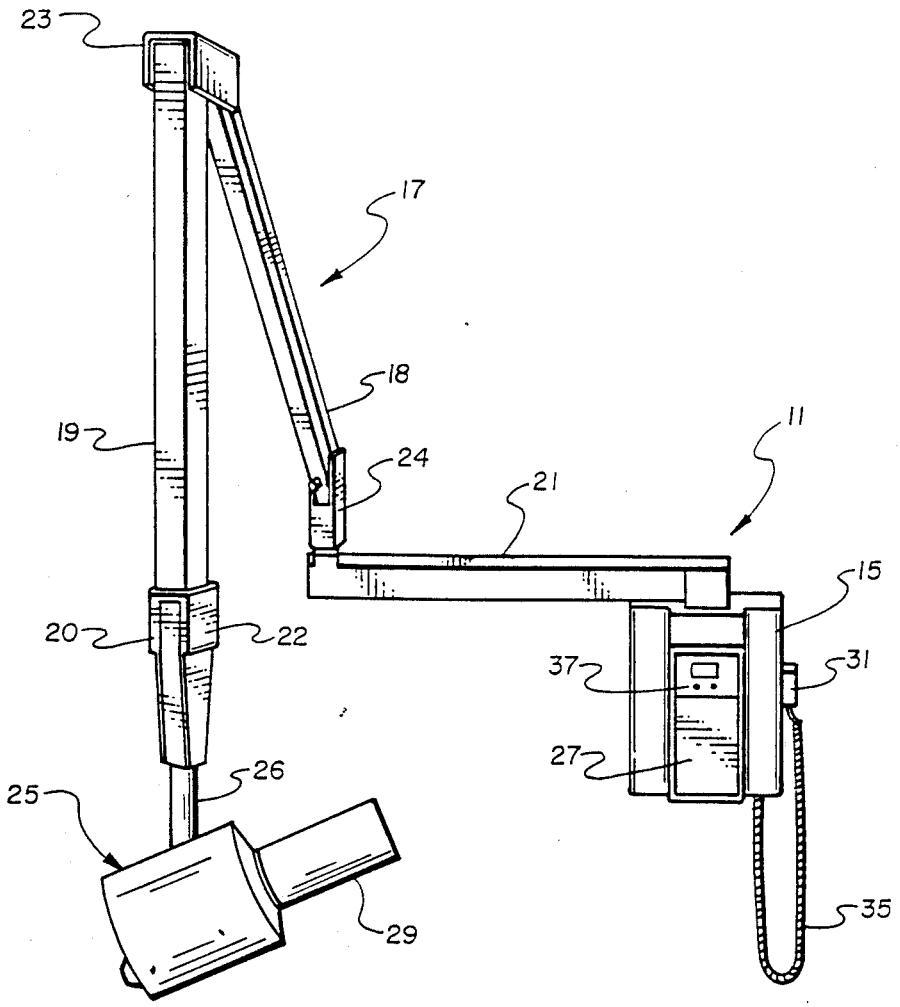
FIG. 1 is a perspective view of the tube head assembly of this invention, mounted and associated with structural and electronic components in a finished X-ray machine.

The invention is shown embodied as a dental X-ray machine, indicated generally 11 in FIG. 1. It includes a wall-mounted support fixture 15 which provides bearing support for a folding arm assembly, designated generally 17, consisting of a first arm 18 and a second arm 19, the latter of which carries a distal arm 20 and the former of which is carried at the distal end of a horizontal pivoting arm 21. The arms 18 and 19 are connected together in pivot or hinged relation at a capped joint 23. The first arm 18 and pivoting horizontal arm 21 are connected at a joint 24 which provides both a pivoted and swivel connection. A tube head assembly 25 is suspended from the distal arm 20 by means of a trunnion member 26. A beam limiting device (cone) projects from the tube head assembly. A housing 27 associated with the wall mounting fixture 15 contains electronic components and a remote exposure button 31 connected by a coiled cord 35 to the housing. The machine is operated by manually positioning the tube head assembly 25 by extending and rotating as appropriate the arm assembly 17 and by pressing switches contained in a membrane switch panel 37.

Figure 2:
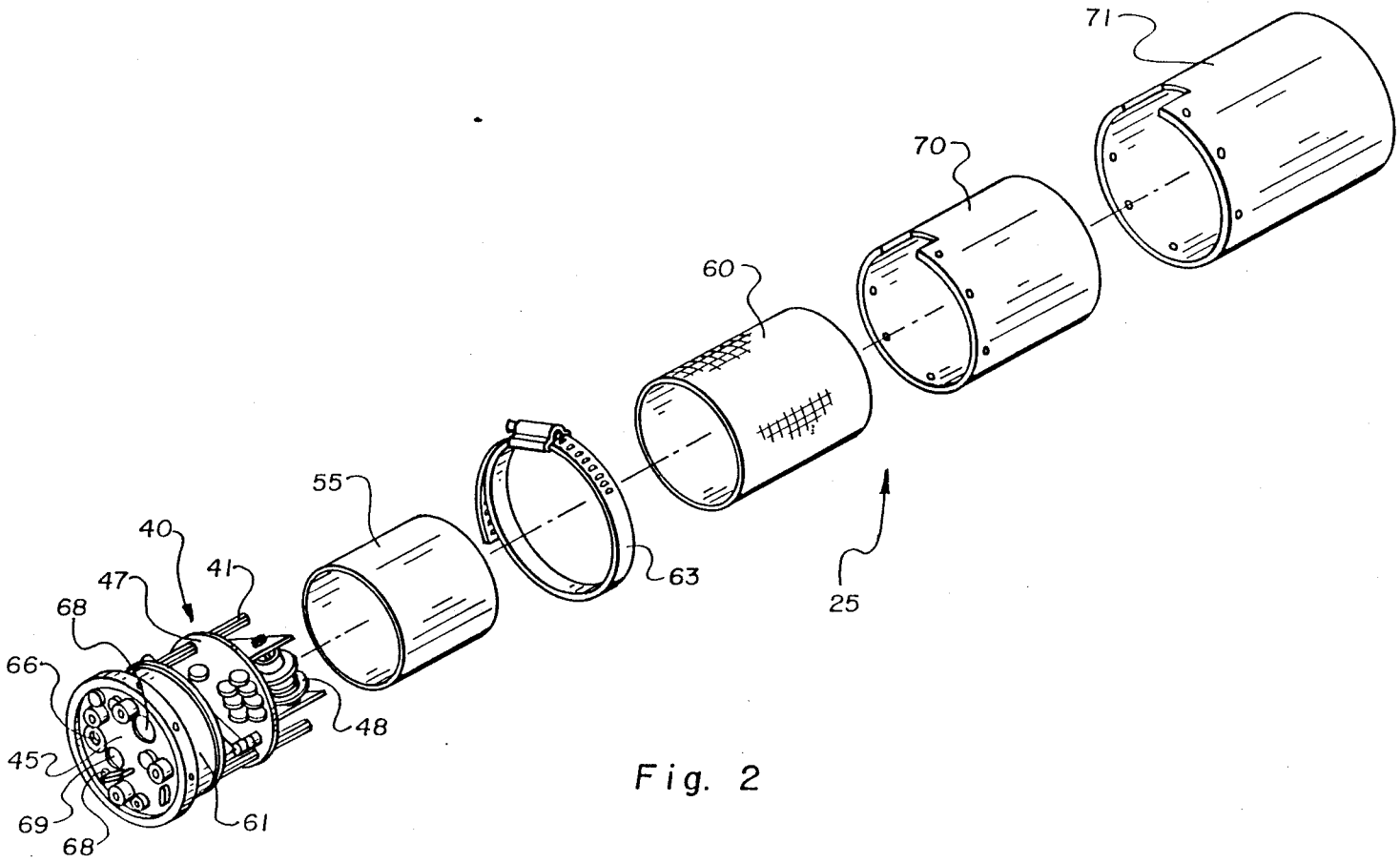
FIG. 2 is an exploded view in perspective showing individual components of an improved tube head assembly of this invention.
Figure 3:
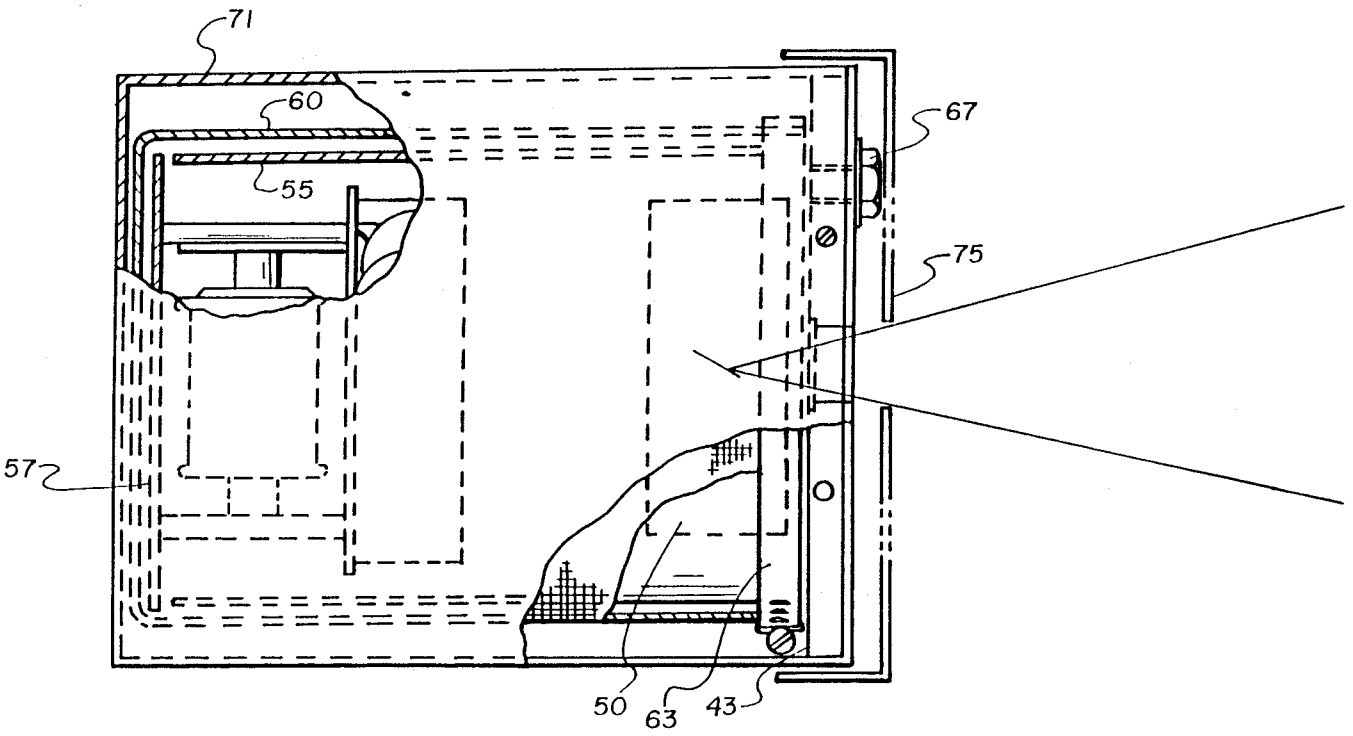
FIG. 3 is a cross-sectional view showing the components of FIG. 2 in assembled condition together with certain additional components.

The electronic components within the housing 27 and the tube head assembly 25 may be conventional, such as those illustrated by the aforementioned U.S. Pat. No. 4,350,891, or they may be of equivalent or improved construction. In any event, the details of construction of the improved tube head assembly 25 of this invention are best illustrated by FIGS. 2 and 3.

The tube head assembly 25 includes a high-voltage subassembly, designated generally 40, mounted by means of upstanding posts 41 to the mounting surface 43 (FIG. 3) of a bulkhead 45 which functions as the mounting element of the assembly 25. The high-voltage subassembly 40 is mounted on a plate 47, and includes a transformer 48 and other components as shown by FIG. 2. This subassembly 40 drives the X-ray tube 50 (FIG. 3) which is mounted on the support surface 43 between the high-voltage subassembly 40 and the bulkhead 45. A structural sleeve 55 is mounted to enclose the high-voltage subassembly 40 and X-ray tube 50. The sleeve 55 is desirably constructed of a high dielectric insulating material such as polyester resin. An exemplary material for this purpose is that marketed under the trade name of "MYLAR." The sleeve 55 is illustrated held in place abutting the mounting surface 43 of the bulkhead 45 by means of an end plate 57 bolted to the distal ends of the posts 41 as best seen in FIG. 3.

A resilient elastomeric cylindrical enclosure 60 couples to peripheral structure 61 by means of the clamp 63. The enclosure 60 has a single open end 65 adapted to fit snugly over the peripheral structure 61 so that it effects a tight oil seal when clamped in place by the clamp 63. As so positioned, it fits loosely over the sleeve 55 so that oil is permitted to flow between the outer surface of the sleeve 55 and the inner surface of the enclosing element 60. With the interior of the enclosure element 60 filled with oil, oil is in contact with the elements of the high-voltage subassembly 40 and the X-ray tube 50. The ports through the bulkhead 45 visible in FIG. 2 are sealed by other structures when the assembly is completed as illustrated by FIG. 3. The oil fill port 66 is sealed by a screw and suitable seal 67. The access holes 68 are sealed by electrical connector headers (not shown). The X-ray port 69 is sealed with a conventional aluminum filter disk (not shown). The plastic liner 70 and lead housing 71 are positioned eccentrically over the other components as shown in FIG. 3. A lead lined (or lead) cap 75 is provided in conventional fashion.

In assembled condition, as oil contained within the envelope formed by the bulkhead 45 and the container 60 expands due to heat, the walls of the container 60 are deformed outwardly toward the internal surface of the liner 70. As oil cools, the walls of the container 60 recede away from the liner 70 towards the sleeve 55. Thus, the element 60 serves both as a fluid-tight container for oil and as means for accommodating the expansion and contraction of contained oil under the influence of fluctuating temperatures.

Reference herein to details of the illustrated embodiment are not intended to limit the scope of the appended claims which themselves recite those features regarded as important to the invention.

What is claimed:

1. In a tube head assembly for an X-ray machine of the type wherein a high-voltage subassembly including a transformer and associated circuitry is immersed in oil within a housing, said housing being sealed against oil leakage while providing for the expansion and contraction of oil within said housing, the improvement comprising:

a mounting element, including a rigid mounting surface, constituting means for carrying the components of said high-voltage subassembly, said mounting surface being circumscribed by peripheral structure configured to couple with the open end of an enclosing element of elastomeric material;

a said enclosing element of elastomeric material positioned to enclose said high voltage subassembly within a continuous envelope, said envelope having an opening coupled in fluid-sealed relationship with said peripheral surface; said enclosing element being filled with oil; and an X-ray-shielding housing attached to said mounting element and containing said enclosing element, the internal volume of said housing being sufficient to accommodate the expanded volume of said enclosing element when said oil is in an expanded condition due to heating.

2. An improvement according to claim 1, wherein said enclosing element has a characteristic unexpanded volume and is sufficiently resilient that it tends to return to said characteristic volume at any time that said oil decreases in volume due to decreases in its temperature.

3. An improvement according to claim 2, wherein said housing is comprised of lead.

4. An improvement according to claim 1, including a structural sleeve positioned between said high-voltage subassembly and said enclosing element, said structural sleeve constituting means for physically limiting the approach of said enclosing element toward said high-voltage subassembly.

5. An improvement according to claim 4, wherein said structural sleeve is constructed of insulating material and further constitutes means for maintaining the insulation integrity of the tube head assembly.

6. An improvement according to claim 4, including a liner element between said housing and said enclosing element and extending from said mounting element, constituting support means for shielding material comprising said housing.

7. An improvement according to claim 1, wherein said mounting element is a cylindrical plate, one surface of which constitutes said rigid mounting surface; said enclosing element is a substantially cylindrical vessel with a single open end constituting said opening of said envelope; and said enclosing element is mounted in axial alignment with said mounting element

8. An improvement according to claim 1 wherein said housing is a substantially cylindrical vessel with a single open end mounted concentrically with respect to said enclosing element and said mounting element

9. An improvement according to claim 8, wherein said enclosing element has a characteristic unexpanded volume and is sufficiently resilient that it tends to return to said characteristic volume at any time that said oil decreases in volume due to decreases in its temperature.

10. An improvement according to claim 9, wherein said housing is constructed of lead.

11. An improvement according to claim 9, including a structural sleeve positioned between said high-voltage subassembly and said enclosing element, said structural sleeve constituting means for physical limiting the approach of said enclosing element toward said high-voltage subassembly.

12. An improvement according to claim 11, wherein said sleeve is approximately cylindrical in shape and is mounted concentrically with respect to said enclosing element.

13. An improvement according to claim 12, wherein said structural sleeve is constructed of insulating material and further constitutes means for maintaining the insulation integrity of the tube head assembly.

14. An improvement according to claim 12, including a liner element between said housing and said enclosing element and extending from said mounting element, constituting support means for shielding material comprising said housing.

15. An improvement according to claim 14, wherein said structural sleeve is constructed of insulating material and further constitutes means for maintaining the insulation integrity of the tube head assembly.

16. In a tube head assembly for an X-ray machine of the type wherein a high-voltage subassembly including a transformer and associated circuitry is immersed in oil in association with an X-ray tube within a housing, said housing being sealed against oil leakage while providing for the expansion and contraction of oil within said housing, the improvement comprising:

a mounting element, including a rigid mounting surface, constituting means for carrying said X-ray tube and the components of said high-voltage subassembly, said mounting surface being circumscribed by peripheral structure configured to couple with the open end of an enclosing element of elastomeric material;

a said enclosing element of elastomeric material positioned to enclose said high voltage subassembly within a continuous envelope, said envelope having an opening coupled in fluid-sealed relationship with said peripheral surface and being filled with oil; and an X-ray-shielding housing attached to said mounting element and containing said enclosing element, the internal volume of said housing being sufficient to accommodate the expanded volume of said enclosing element when said oil is in an expanded condition due to heating, whereby said X-ray tube and said high voltage subassembly are isolated from said X-ray shielding housing by said enclosing element.

17. An improvement according to claim 16 including a structural insulating sleeve positioned between said enclosing element and the X-ray tube and other components carried by said rigid mounting surface.

* * * * *